US005926671A

United States Patent [19]

Leibman

[11] Patent Number: 5,926,671

[45] Date of Patent: Jul. 20, 1999

[54] INTEGRAL MULTI-FUNCTION LATCH

[75] Inventor: Bernard Leibman, Webster, N.Y.

[73] Assignee: Xerox Corporation, Stamford, Conn.

[21] Appl. No.: 09/131,116

[22] Filed: Aug. 7, 1998

[51] Int. Cl.[6] ..... G03G 15/00

[52] U.S. Cl. ..... 399/110; 312/333

[58] Field of Search ..... 399/107, 110, 399/111, 115, 116, 119, 122; 312/332.1, 333; 292/169, DIG. 30, 140

[56] References Cited

U.S. PATENT DOCUMENTS

| | | | |
|---|---|---|---|
| 2,637,576 | 5/1953 | Nottingham . | |
| 3,737,184 | 6/1973 | Swartz | 292/170 |
| 3,876,317 | 4/1975 | Jordon | 403/167 |
| 4,123,734 | 10/1978 | Maier et al. . | |
| 4,295,732 | 10/1981 | Hull et al. . | |
| 4,436,355 | 3/1984 | Fortune | 312/270.2 |
| 4,515,468 | 5/1985 | Taylor et al. | 355/27 |
| 4,989,035 | 1/1991 | Leonhart . | |
| 5,157,448 | 10/1992 | Lang . | |
| 5,445,451 | 8/1995 | Harmony | 312/333 |
| 5,583,612 | 12/1996 | Schell et al. | 399/107 |
| 5,767,977 | 6/1998 | Thelen et al. | 358/296 |
| 5,819,139 | 10/1998 | Harlan et al. | 399/110 |

*Primary Examiner*—Robert Beatty
*Attorney, Agent, or Firm*—John S. Wagley

[57] ABSTRACT

An actuator for actuating a latch for releaseably securing a movable member to a frame is disclosed. The actuator includes a body, a first member operably associated with said body for urging the latch toward engagement with the frame and a second member operably associated with the body for urging the latch toward disengagement with the frame wherein the body, the first member, and the second member are turned from a one-piece construction. A separating member is operably associated with the actuator for separating the actuator from the frame.

16 Claims, 4 Drawing Sheets

INTEGRAL MULTI-FUNCTION LATCH

The present invention relates to a printing apparatus. More specifically, the invention relates to an integral multi-function latch for use in a printing machine.

The features of the present invention are useful in any machine requiring a latch to secure a movable member. One such machine is a printing machine, for example electrophotographic printing machine.

In the process of electrophotographic printing, a photoconductive surface is charged to a substantially uniform potential. The photoconductive surface is image wise exposed to record an electrostatic latent image corresponding to the informational areas of an original document being reproduced. This records an electrostatic latent image on the photoconductive surface corresponding to the informational areas contained within the original document. Thereafter, a marking material such as toner particles is transported into contact with the electrostatic latent image in a region known as the development zone. Toner particles are attracted from the magnetic roller to the latent image. The resultant toner powder image is then transferred from the photoconductive surface to a copy sheet and permanently affixed thereto. The foregoing generally describes a typical mono-color single component development electrophotographic copying machine.

Machines and devices require access to the internal workings and components of the machines. To accommodate the access to the machines, machines are often designed with modules and drawers which are slidably positioned into an open position where access may be obtained and a closed position in which the machine may operate. Further, the machines may include doors which are rotated into an open position and rotated into a closed position.

The modules drawers and doors need to be secured in their closed position. Various latching mechanisms have been used to maintain doors, drawers and modules in their closed position. Prior art latching mechanisms typically have included many expensive, intricate and precise metal components. These mechanisms have been complex and expensive. These prior art latching mechanisms require difficult, expensive assembly and disassembly. Furthermore, the prior art latching mechanisms require a separate distinct handle from the latching mechanism which further complicates the mechanism and makes the mechanism more expensive. Further prior art latching mechanisms being made of metal require maintenance including the lubrication of the metal components so that corrosion and other wear does not occur prematurely.

The following disclosures may be relevant to various aspects of the present invention:

U.S. Pat. No. 5,767,977
Patentee: Thelen et al.
Issue Date: Jun. 16, 1998

U.S. Pat. No. 5,583,612
Patentee: Schell et al.
Issue Date: Dec. 10, 1996

U.S. Pat. No. 5,157,448
Patentee: Lang
Issue Date: Oct. 20, 1992

U.S. Pat. No. 4,989,035
Patentee: Leonhart
Issue Date: Jan. 29, 1991

U.S. Pat. No. 4,515,468
Patentee: Taylor et al.
Issue Date: May 7, 1985

U.S. Pat. No. 4,295,732
Patentee: Hull
Issue Date: Oct. 20, 1981

U.S. Pat. No. 4,123,734
Patentee: Maier et al.
Issue Date: Oct. 31, 1978

U.S. Pat. No. 3,876,317
Patentee: Jordan
Issue Date: Apr. 8, 1975

U.S. Pat. No. 5,767,977 discloses an improved carriage locking system that prevents the power cord of an optical scanner from being plugged into the scanner when the optical carriage assembly of the scanner is in the locked position. The locking system may include a locking member that the user unlocks to access the power cord receptacle upon initial setup of the scanner. The locking system may also include a spring loaded locking member that latches the optical carriage assembly against movement whenever the power cord is removed from the power cord receptacle.

U.S. Pat. No. 5,583,612 discloses a latch for releasably securing a member to a support structure. The latch includes a substantially rigid member mounted pivotably in the member. The rigid member includes a catch disposed at one end thereof and a handle at another end thereof. The rigid member also includes a substantially resilient member coupled to the rigid member for urging the rigid member to pivot to a position in which the catch thereof engages the support structure to secure the member thereto. The handle is adapted to pivot the rigid member to release the catch from engagement with the support structure to release the member.

U.S. Pat. No. 5,157,448 discloses a reproduction machine paper loading drawer interlock system which provides protection from jams by preventing drawer opening during sheet feeding therefrom, yet provides more frequent and/or rapid drawer access for copy paper loading, particularly desirable for loading one drawer while running the machine and feeding sheets from another drawer, by independently operating each paper drawer interlock from the existing wiring and electrical signals for the paper feeder drive for that drawer, without any wiring or unique software requirements from the machine controller, or requiring any machine "cycle out" signals therefrom, or actuation of any manually actuated unlocking switches.

U.S. Pat. No. 4,989,035 discloses a latch system for a vacuum frame has a plurality of separate latching mechanisms interconnected with a common actuator rod so that the glass frame can raised with one hand.

U.S. Pat. No. 4,515,468 discloses a light-tight, elongated, hollow tapered wall base to which a slide housing is movably connected. The slide housing includes a light source which produces a light beam which passes through a filter assembly and a lens assembly to the bottom of the base. A photographic transparency is to be mounted within a slide holder which in turn is movably located in a close fitting relationship within a slide receiving station. The slide receiving station is formed within the slide housing between the filter assembly and the lens assembly. Removably connected to the bottom of the base is a photographic print tray assembly. The photographic print tray assembly includes a focusing target. The image projected from the photographic transparency is to be observed on the focusing target by a view port which is formed within the base. At the desired time, the focusing target is to be removed and the projected image utilized to expose an unexposed photographic print which has previously been incorporated within the photographic print tray assembly.

U.S. Pat. No. 4,295,732 discloses a system for duplicating images wherein a copy sheet is delivered to a first gripper of an impression cylinder. A first image is transferred to one side of each sheet, and each sheet is then released by the first gripper and delivered to a reversing means. A second gripper includes means for engaging the trailing edge of each sheet and the sheets are thus re-fed to the impression cylinder by this second gripper, trailing edge first. The re-feeding is in synchronism with the second image whereby this second image is transferred to the opposite side of each sheet. The second gripper is provided with inverting means to accommodate the re-feeding. In addition, separate gripper means are provided on the second gripper for engaging the trailing edge of a succeeding sheet whereby the second gripper simultaneously engages the trailing edge of one sheet and the formerly trailing edge of a previously introduced sheet.

U.S. Pat. No. 4,123,734 discloses a three pole molded case circuit breaker including a push-to-trip button, a flux transfer shunt trip mechanism, an undervoltage trip mechanism, and an improved latch mechanism. The latch mechanism comprises a metal trip bar covered with insulating tubing and adapted for translational movement to actuate the latch mechanism and trip the contacts. Contact carrier movement during the tripping operation serves to reset the latch mechanism.

U.S. Pat. No. 3,876,317 discloses a reproduction machine employing a heated roll fuser for fixing the transferred developed image on a support material, the fuser back-up roll being held against the driven, heated roll by a latch mechanism employing a rotatable bolt-handle, rotation of the bolt causing the back-up roll to unlatch and allow the roll to be pivoted out of contact with the heated fuser roll by a lifting force on the bolt handle to provide single handed disengagement and movement of the roll to enable the machine operator to clear jams in the fuser with the free hand.

In accordance with one aspect of the present invention, there is provided an actuator for actuating a latch for releaseably securing a movable member to a frame. The actuator includes a body, a first member operably associated with the body for urging the latch toward engagement with the frame and a second member operably associated with the body for urging the latch toward disengagement with the frame.

In accordance with a further aspect of the present invention, there is provided a latch for releaseably securing a movable member to a frame. The latch includes a housing mounted to the movable member and a pin movably mounted to the housing for selectable engagement and disengagement with the frame. The latch also includes an actuator movably mounted to the housing and cooperating with the pin. The actuator has a first relaxed position in which the pin is in engagement with the frame and a second restrained position in which the pin is in disengagement with the frame.

In accordance with a further aspect of the present invention, here is provided a drawer slidably mounted to a frame for use in a printing machine. The drawer includes a latch for releaseably securing the drawer to a frame of the printing machine. The latch includes a housing mounted to the movable member and a pin movably mounted to the housing for selectable engagement and disengagement with the frame. The latch further includes an actuator movably mounted to the housing and cooperating with the pin. The actuator has a first relaxed position in which the pin is in engagement with the frame and a second restrained position in which the pin is in disengagement with the frame.

In accordance with another aspect of the present invention, there is provided a printing machine of the type having a drawer slidably mounted to a frame. The drawer includes a latch for releaseably securing the drawer to a frame of the printing machine. The latch includes a housing mounted to the movable member and a pin movably mounted to the housing for selectable engagement and disengagement with the frame. The latch further includes an actuator movably mounted to the housing and cooperating with the pin. The actuator has a first relaxed position in which the pin is in engagement with the frame and a second restrained position in which the pin is in disengagement with the frame.

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 3:
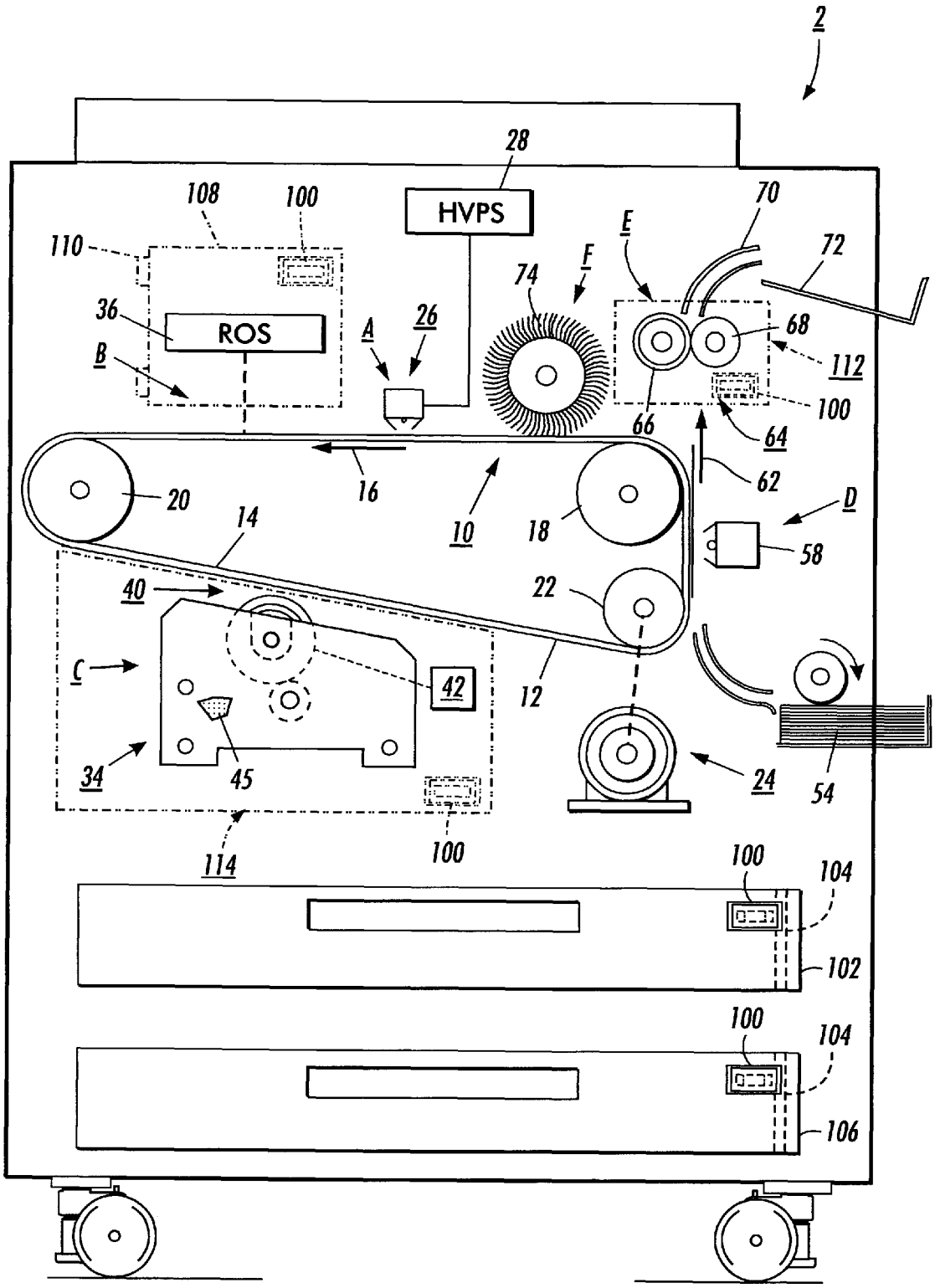
FIG. 3 is a schematic elevational view of an electrophotographic printing machine incorporating the FIG. 1 multi-purpose integrally molded latch of the present invention.

For a general understanding of the illustrative electrophotographic printing machine incorporating the features of the present invention therein, reference is made to the drawings. In the drawings, like reference numerals have been used throughout to designate identical elements. FIG. 3 schematically depicts the various components of an electrophotographic printing machine incorporating the vibration isolation feature of the present invention therein. Although the vibration isolation feature of the present invention is particularly well adapted for use in the illustrative printing machine, it will become evident that the vibration isolation feature is equally well suited for use in a wide variety of printing machines and are not necessarily limited in its application to the particular embodiment shown herein.

Referring now to FIG. 3, the electrophotographic printing machine shown employs a photoconductive belt 10, although photoreceptors in the form of a drum are also known, and may be substituted therefor. The belt 10 has a photoconductive surface 12 deposited on a conductive substrate 14. Belt 10 moves in the direction of arrow 16 to advance successive portions thereof sequentially through the various processing stations disposed about the path of movement thereof. Motor 24 rotates roll 22 to advance belt 10 around rolls 18, 20 and 22 in the direction of arrow 16. Belt 10 is coupled to motor 24 by suitable means such as a drive.

Initially successive portions of belt 10 pass through charging station A. At charging station A, a corona generating device, indicated generally by the reference numeral 26, charges the belt 10 to a selectively high uniform electrical potential, preferably negative. Any suitable control, well known in the art including for example HVPS 28, may be employed for controlling the corona generating device 26.

In a digital printing machine as shown in FIG. 3, the belt 10 passes through imaging station B where a ROS (Remote Optical Scanner) 36 may lay out the image in a series of horizontal scan lines with each line having a specific number of pixels per inch. The ROS 36 may include a laser (not shown) having a rotating polygon mirror block associated therewith. The ROS 36 exposes the photoconductive surface 12 of the belt.

It should be appreciated that the printing machine may alternatively be a light lens copier. In a light lens copier a document to be reproduced is placed on a platen, located at the imaging station, where it is illuminated in known manner by a light source such as a tungsten halogen lamp. The document thus exposed is imaged onto the drum by a system of mirrors. The optical image selectively discharges the surface of the drum in an image configuration whereby an electrostatic latent image of the original document is recorded on the drum at the imaging station.

At development station C, a magnetic development system or unit, indicated generally by the reference numeral 34 advances developer materials into contact with the electrostatic latent images. Preferably, the magnetic developer unit includes a magnetic developer roller mounted in a housing. Thus, developer unit 34 contains a magnetic roller 40. The roller 40 advances toner particles 45 into contact with the latent image. Appropriate developer biasing is may be accomplished via power supply 42, electrically connected to developer unit 34.

The developer unit 34 develops the charged image areas of the photoconductive surface. This developer unit contains magnetic black toner, for example, particles 45 which are charged by the electrostatic field existing between the photoconductive surface and the electrically biased developer roll in the developer unit. Power supply 42 electrically biases the magnetic roll 40.

A sheet of support material 54 is moved into contact with the toner image at transfer station D. The sheet of support material is advanced to transfer station D by a suitable sheet feeding apparatus, not shown. Preferably, the sheet feeding apparatus includes a feed roll contacting the uppermost sheet of a stack copy sheets. Feed rolls rotate so as to advance the uppermost sheet from the stack into a chute which directs the advancing sheet of support material into contact with the photoconductive surface of belt 10 in a timed sequence so that the toner powder image developed thereon contacts the advancing sheet of support material at transfer station D.

Transfer station D includes a corona generating device 58 which sprays ions of a suitable polarity onto the backside of sheet 54. This attracts the toner powder image from the belt 10 to sheet 54. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 54. Preferably, fuser assembly 64 comprises a heated fuser roller 66 and a pressure roller 68. Sheet 54 passes between fuser roller 66 and pressure roller 68 with the toner powder image contacting fuser roller 66. In this manner, the toner powder image is permanently affixed to sheet 54. After fusing, a chute 70 guides the advancing sheet 54 to a catch tray 72 for subsequent removal from the printing machine by the operator. It will also be understood that other post-fusing operations can be included, for example, stapling, binding, inverting and returning the sheet for duplexing and the like.

After the sheet of support material is separated from the photoconductive surface of belt 10, the residual toner particles carried by image and the non-image areas on the photoconductive surface are charged to a suitable polarity and level by a preclean charging device (not shown) to enable removal therefrom. These particles are removed at cleaning station F. The vacuum assisted, electrostatic, brush cleaner unit is disposed at the cleaner station F. The cleaner unit has a brush roll 74 that rotates at relatively high speeds which creates mechanical forces that tend to sweep the residual toner particles into an air stream (provided by a vacuum source), and then into a waste container. Subsequent to cleaning, a discharge lamp or corona generating device (not shown) dissipates any residual electrostatic charge remaining prior to the charging thereof for the next successive imaging cycle.

It is believed that the foregoing description is sufficient for purposes of the present application to illustrate the general operation of an electrophotographic printing machine incorporating the latch of the present invention therein.

According to the present invention, and referring again to FIG. 3, an integral multi-function latch 100 according to the present invention is shown in use in printing machine 2. The latch 100 is used to secure upper drawer 102 to frame 104 of the printing machine 2. The latch 100 may also be used to secure lower drawer 106 to the frame 102. Optionally, the latch 100 may be utilized to secure any of a number of doors 108 to the printing machine 2. The doors 108 may be pivotally mounted by hinges 110 to the printing machine 2. Also, the latch 100 may be utilized to secure modules, for example, fuser module 112 and development module 114, to the printing machine 2.

Figure 4:
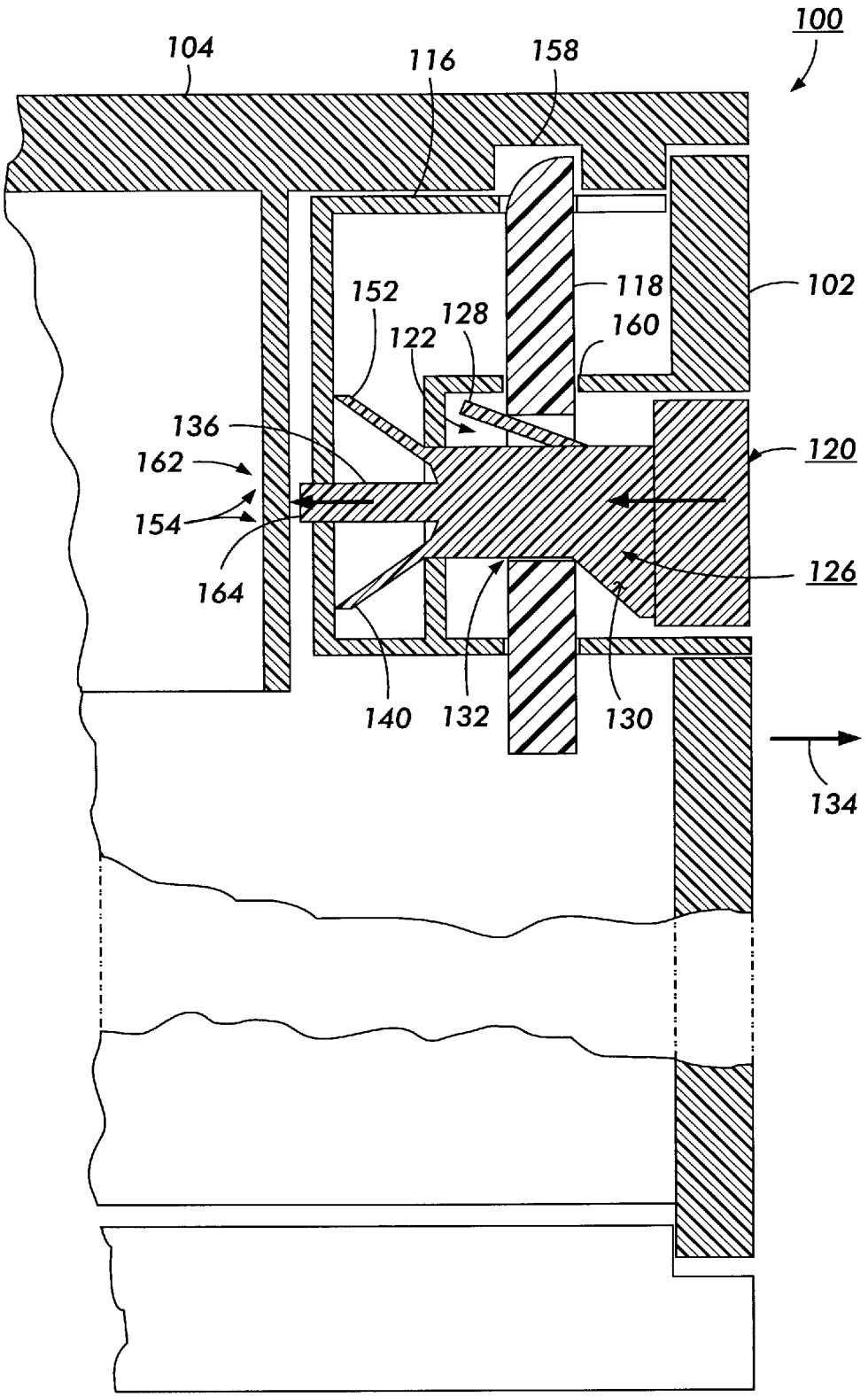
FIG. 4 is a partial top view of a paper tray with the FIG. 1 multi-purpose integrally molded latch of the present invention showing the latch in the engaged position.

Referring now to FIG. 4, the latch 100 is shown in greater detail installed to secure drawer 102 to frame 104. The latch 100 includes a housing 116 mounted to the drawer 102. The latch 100 further includes a latching bar or pin 118 which is movably mounted to the housing 116 for selectable engagement and disengagement with the frame 104.

The latch 100 further includes an actuator 120 which is movably mounted to the housing 116 and cooperates with the pin 118. The actuator has a first relaxed position 122 in which the pin 118 is in engagement with the frame 104 as shown in FIG. 4.

Figure 5:
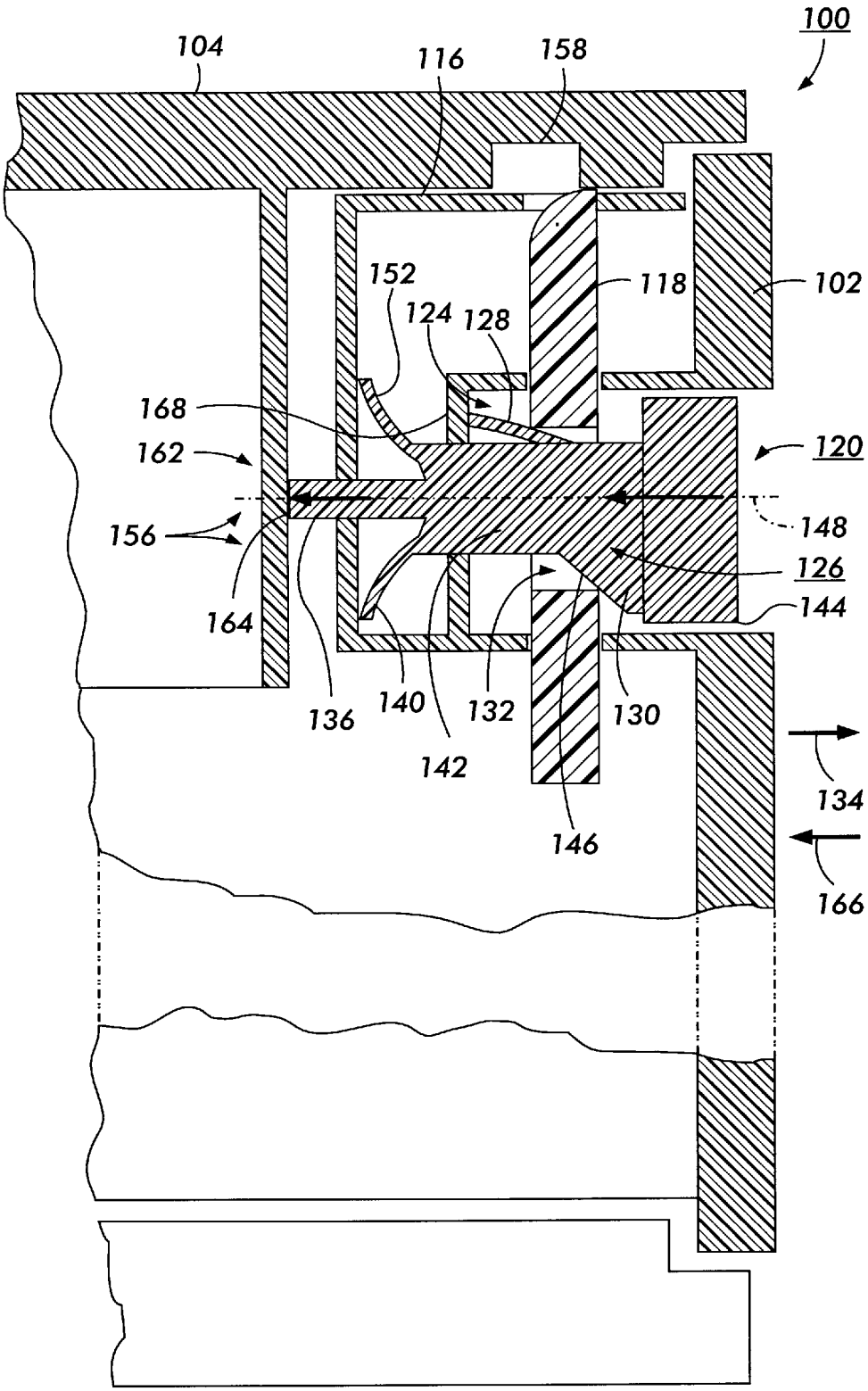
FIG. 5 a partial top view of a paper tray with the FIG. 1 multi-purpose integrally molded latch of the present invention showing the latch in the disengaged position.

Referring now to FIG. 5, the actuator 120 also has a second restrained position 124 in which the pin 118 is in disengagement with the frame 104.

Referring again to FIG. 4, the frame 104, the drawer 102, and the pin 118 may be made of any suitable durable material. For example, the frame 104, the pin 118, and the drawer 102 may be made of a metal or a plastic. For example, the frame 104, the pin 118, and the drawer 102 may be made of polypropylene and may include glass fibers for reinforcement.

The housing 116 may be made of any suitable durable material, for example a plastic or a metal. The housing 116 may be a separate component from the drawer 102 or for simplicity, may be integrally molded with the drawer 102. When the housing 116 and the drawer 102 are integrally molded, typically they are molded from a plastic material.

The actuator 120 preferably includes a body 126 and a first member 128 associated with the body 126 for urging the latch 100 toward engagement with the frame 104. The actuator preferably includes a second member 130 operably associated with the body 126 for urging the latch 120 toward disengagement with the frame 104. Preferably, as shown in FIG. 5, the body 126, the first member 128, and the second member 130 comprise a one-piece construction and are integrally molded from a plastic material.

As shown in FIG. 5, preferably, the pin 118 includes an aperture 132 therein. The actuator 120 is preferably positioned such that at least a portion of the actuator 120 is positioned within the opening 132 of the pin 118.

Preferably, the first member 128 includes a portion of the member 128 which is made of a resilient material, for example a plastic. The resilient portion of the first member 128 has the first relaxed position 122 as shown in FIG. 4, in which the latch 100 is in engagement with the frame 104.

Referring again to FIG. 5, the first member 128 includes a portion thereof made of a resilient material which has the restraint position 124 in which the latch 100 is in disengagement with the frame 104 so that the drawer 102 may be slid from the frame 104 in the direction of arrow 134.

Referring again to FIG. 4, the latch 100 preferably further includes a separating member 136 operably associated with the actuator 120 for separating the drawer 120 from the frame 104.

The latch 100 preferably further includes an urging member 140 which is also operably associated with the actuator 120 for urging the actuator 120 toward a position with respect to the drawer 102 so that the latch 100 may be in engagement with the frame 104.

Figure 1:
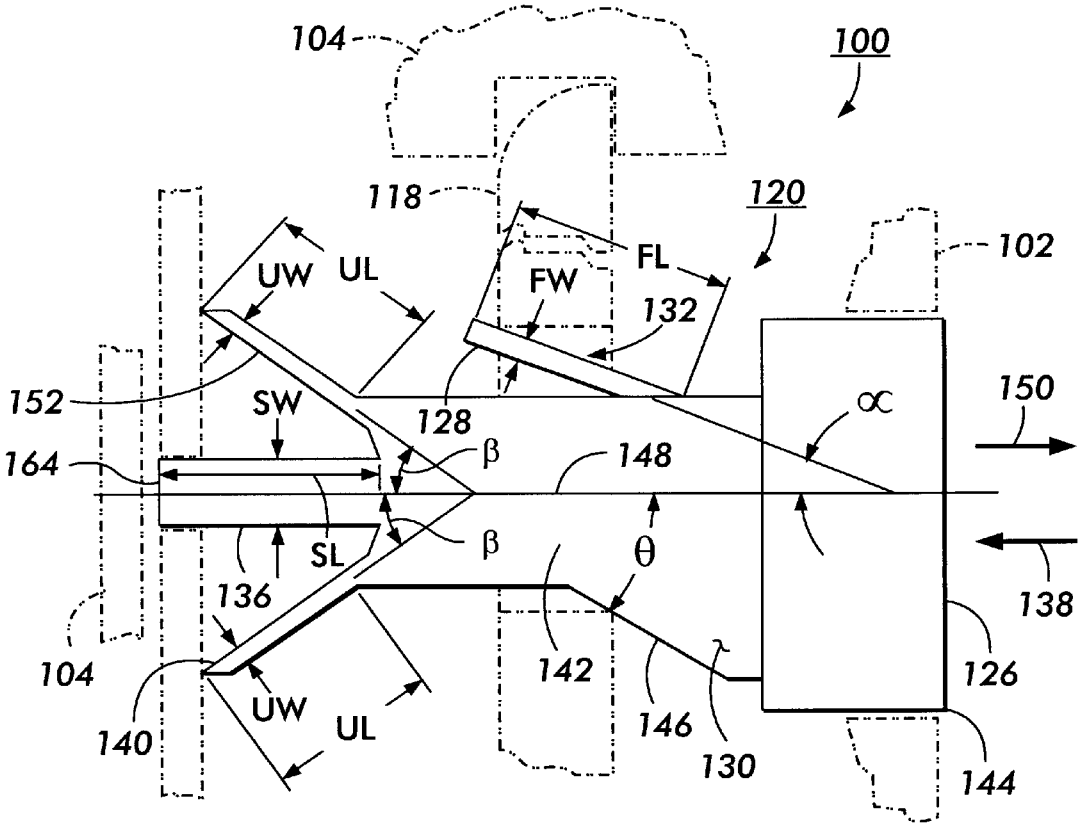
FIG. 1 is a plan view of a multi-purpose integrally molded latch according to the present invention.

Referring now to FIG. 1, the actuator 120 is shown in greater detail. The body 126 of the actuator 120 includes a central portion 142 and a button portion 144 extending from the central portion 142. To actuate the actuator 120, an operator depresses the button portion 144 of the actuator 120 in the direction of arrow 138.

First member 128 extends outwardly from the central portion 142 of the body 126. The first member 128 may have any suitable shape capable of providing the resilient feature for the first member 128. Preferably, however, the first member 128 has a generally rectangular shape including a width FW of, for example, 0.10 inches and a thickness T (see FIG. 2) of, for example, 0.30 inches. The first member 128 extends outwardly from the central portion 142, a distance FL of, for example, 0.50 inches at an angle of, for example, $\alpha$ of, for example, 20° from longitudinal axis 148 of actuator 120.

The second member 130 is utilized to urge the pin 118 in a direction toward a disengaged position with respect to the frame 104. As shown in FIG. 1, the second member 130 is integral with the central portion 142 of the body 126 and includes a surface 146 of the central portion 142. The surface 146 is defined by angle $\theta$ with respect to the longitudinal axis 148 of actuator 120 of, for example, 45°

Figure 2:
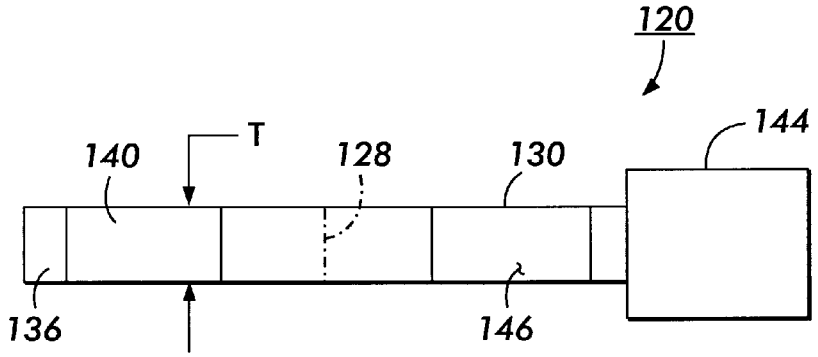
FIG. 2 is an end view of a multi-purpose integrally molded latch according to the present invention.

The separating member 136 extends outwardly from the central portion 142 of the body 126. The separating member 136 may have any suitable shape, but preferably as shown in FIGS. 1 and 2, has a generally rectangular shape, having a width SW and a thickness T (for simplicity the thickness of T is preferably identical to that of the first member 128 of 0.3 inches) as well as a length SL. The width SW may be, for example, 0.26 inches, and the length SL may be, for example, 0.50 inches. The separating member 136 preferably includes a contact surface 164 for contact with the frame 104.

The separating member 136 provides at least two features. First, the separating member 136 provides a positive stop for the actuator 120 against the frame 104, thus preventing the overflexing of the urging member 140. Also, the separating member 136 provides a positive stop for the actuator 120 so that an operator, when pushing against the button portion 144 of the actuator 120 in the direction of arrow 138, may utilize another finger or portion of their body to pull against the drawer 102 in a twisting motion to initiate the opening of the drawer 102.

Urging member 140 is utilized to urge the actuator 120 in the direction of arrow 150 to maintain the pin 118 in the latched position 122 (see FIG. 4). The urging member 140 preferably is integral with the actuator 120 and extends outwardly from central portion 142 of the body 126.

While the urging member 140 may have any suitable shape, preferably, the urging member 140 has a generally rectangular shape and is defined by a thickness T (for simplicity the thickness of T is preferably identical to that of the first member 128 of 0.3 inches), a width UW of, for example, 0.05 inches, and a length UL of, for example, 0.5 inches. To assure that the urging member 140 may cause the actuator 120 to be biased in the direction of arrow 150, the urging member extends outwardly from the central portion 142 at an angle $\beta$ of, for example, 30° with respect to the longitudinal axis 148 of the actuator 120.

While a single urging member 140 may be sufficient for biasing the actuator in the direction of arrow 150, preferably, to provide for a force in the direction of arrow 150 without a bias in a direction skewed from longitudinal axis 148, the actuator 120 further includes a second urging member 152 which is similar and symmetrical to first urging member 140.

Referring again to FIGS. 4 and 5, the urging members 140 and 152 have a resilient portion thereof for urging the actuator 120 in the direction of arrow 134. The urging members 140 and 152 have a first relaxed position 154 as shown in FIG. 4, in which the latch 100 may be in engagement with the frame 104 and, as shown in FIG. 5, a second restrained position 156 in which the latch 100 may not be in engagement with the frame 104.

Preferably, as shown in FIG. 1, the body 126 including the central portion 142 and the button portion 144 as well as the separating member 136, the urging members 140 and 152 as well as the first member 128 and the second member 130 are integrally molded from a plastic material. Preferably, the actuator 120 is molded from a plastic material that is a resilient plastic material. Such resilient plastic materials include an acetyl or a nylon.

Referring again to FIG. 4, the latch 100 is shown in a position with the drawer 102 in a closed position. The pin 118 is shown engaged with notch 158 formed in the frame 104. The pin 118 is trapped with the opening 132 of the pin 118 being restrained by the actuator 120. The pin 118 is slidably positioned in a slot 160 formed in the housing 116. The first member 128 is in the relaxed position 122 with the first member 128 holding the pin 118 in an upward position with the pin 118 within the notch 158.

The separating member 136 is slidably fitted to aperture 162 formed in the housing 116. End face 164 of the separating member 136 is positioned spaced from the frame 104.

The first urging member 140 and the second urging member 152 are positioned with the distal ends of the urging members 140 and 152 resting freely against the housing 116 in order to keep the actuator 120 in its position with the first member 128 in engagement with the pin 118 to hold it in the locked position. It is preferred to keep the first member 128 as well as the urging members 140 and 152 in a relaxed position when the pin 118 is engaged with the frame 104 so that during most of the operating time of the latch 100, the resilient members 128, 140 and 152 may be at rest, to thereby enhance the life of the latch 100.

Referring again to FIG. 5, the latch 100 is shown in the released position. An operator merely pushes on the button portion 144 of the actuator 120 in the direction of arrow 166. Central portion 142 of the actuator 120 is slidably fitted to guide 168 formed in the housing 116. The guide 118 limits the motion of the actuator 120 to moving along longitudinal axis 148 in the directions of either arrows 134 or 166.

The actuator 120 is permitted to move in the direction of arrow 166 until end face 164 of the separator member 136 contacts the frame 104. When the end face 164 of the actuator 120 contacts the frame 104, the first member 128 is in restrained position 124 because the pin 118 moves along surface 146 of the second member 130 until the pin 118 moves out of the notch 158. The urging members 140 and 152 are deflected as the actuator 120 is pushed in the direction of arrow 166. The restraining of the urging members 140 and 152, when in the position as shown in FIG. 5, creates a force which upon the release of the button portion 144, causes the actuator 120 to return to the position as shown in FIG. 4.

The presence of the separating member 136 limits the motion of the actuator in the direction of arrow 166, such that the urging members 140 and 152 are not strained beyond their elastic limit so that they may return to the position as shown in FIG. 4.

By providing a integral multi-function latch with a molded housing and molded latching bar, as well as a molded actuator, a simple, inexpensive and easy to assemble latch may be provided.

By providing an integral multi-function latch with a one-piece actuator, a simple, inexpensive, easy to assemble latch may be provided.

By providing an integral molded latch with a pin with an aperture for an actuator in a molded body, a simple, inexpensive, easy to assemble latch may be provided.

By providing an integral multi-function latch with an actuator with a resilient urging member to urge the pin into engagement, a simple, inexpensive, easy to assemble latch may be provided.

By providing an integral multi-function latch with an actuator with a resilient urging member to urge the actuator into an engaging position, a simple, inexpensive, and easy to assemble latch may be provided.

By providing an integral multi-function latch with a separating member to limit the motion of the urging members to a void motion beyond the elastic limit, a durable, simple, inexpensive latch may be provided with a long service life.

By providing a integral multi-function latch with an actuator having a cam service in cooperation with a latching pin, a simple, inexpensive, and easy to assemble latch may be provided.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An actuator for actuating a latch for releaseably securing a movable member to a frame, the actuator comprising:

a body;

a first member operably associated with said body for urging the latch toward engagement with the frame; and a second member operably associated with said body for urging the latch toward disengagement with the frame, wherein said body, said first member, and said second member comprise a one-piece construction.

2. An actuator as in claim 1, wherein said body, said first member, and said second member are integrally molded from a plastic material.

3. An actuator for actuating a latch for releaseably securing a movable member to a frame, the actuator comprising:

a body;

a first member operably associated with said body for urging the latch toward engagement with the frame;

a second member operably associated with said body for urging the latch toward disengagement with the frame; and a separating member operably associated with said body for separating the actuator from the frame.

4. An actuator for actuating a latch for releaseably securing a movable member to a frame, the actuator comprising:

a body;

a first member operably associated with said body for urging the latch toward engagement with the frame, wherein said first member comprises a portion thereof made of a resilient material, said resilient portion of said first member having a first relaxed position in which the latch is in engagement with the frame and a second restrained position in which the latch is in disengagement with the frame;

a second member operably associated with said body for urging the latch toward disengagement with the frame, wherein said second member is integral with said body and comprises a surface thereof in sliding contact with the latch;

a separating member operably associated with said body for separating the actuator from the frame, said separating member being integral with said body and comprising a surface thereof in contact with the frame; and an urging member operably associated with said body for urging said actuator toward a latched position with respect to the movable member so that the latch may be in engagement with the frame, said urging member comprising a portion thereof made of a resilient material, said resilient portion of said urging member having a first relaxed position in which the latch may be in engagement with the frame and a second restrained position in which the latch may not be in engagement with the frame, said body, said separating member, said urging member, said first member, and said second member being integrally molded from a plastic material.

5. A latch for releaseably securing a movable member to a frame, the latch comprising:

a housing mounted to the movable member;

a pin movably mounted to said housing for selectable engagement and disengagement with the frame; and an actuator movably mounted to said housing and cooperating with said pin, said actuator having a first relaxed position in which said pin is in engagement with the frame and a second restrained position in which said pin is in disengagement with the frame, said body, said first member, and said second member having a one-piece construction.

6. A latch as in claim 5, wherein said body, said first member, and said second member are integrally molded from a plastic material.

7. A latch for releaseably securing a movable member to a frame, the latch comprising:

a housing mounted to the movable member;

a pin movably mounted to said housing for selectable engagement and disengagement with the frame; and an actuator movably mounted to said housing and cooperating with said pin, said actuator having a first relaxed position in which said pin is in engagement with the frame and a second restrained position in which said pin is in disengagement with the frame; and a separating member operably associated with said actuator for separating said actuator from the frame.

8. A latch for releaseably securing a movable member to a frame, the latch comprising:

a housing mounted to the movable member;

a pin movably mounted to said housing for selectable engagement and disengagement with the frame; and an actuator movably mounted to said housing and cooperating with said pin, said actuator having a first relaxed position in which said pin is in engagement with the frame and a second restrained position in which said pin is in disengagement with the frame, said actuator including a body, a first member operably associated with said body for urging the latch toward engagement with the frame, said first member having a portion thereof made of a resilient material, said resilient portion of said first member having a first relaxed position in which the latch is in engagement with the frame and a second restrained position in which the latch is in disengagement with the frame, and a second member operably associated with said body for urging the latch toward disengagement with the frame, said second member being integral with said body and including a surface thereof in sliding contact with the latch, a separating member operably associated with said body for separating the actuator from the frame, said separating member being integral with said body and comprising a surface thereof in contact with the frame, and an urging member operably associated with said body for urging said actuator toward a latched position with respect to the movable member so that the latch may be in engagement with the frame, said urging member comprising a portion thereof made of a resilient material, said resilient portion of said urging member having a first relaxed position in which the latch may be in engagement with the frame and a second restrained position in which the latch may not be in engagement with the frame, said body, said separating member, said urging member, said first member, and said second member being integrally molded from a plastic material.

9. A drawer slidably mounted to a frame for use in a printing machine, the drawer including a latch for releaseably securing the drawer to a frame of the printing machine, the latch comprising:

a housing mounted to the movable member;

a pin movably mounted to said housing for selectable engagement and disengagement with the frame; and an actuator movably mounted to said housing and cooperating with said pin, said actuator having a first relaxed position in which said pin is in engagement with the frame and a second restrained position in which said pin is in disengagement with the frame, said actuator including a body, a first member operably associated with said body for urging the latch toward engagement with the frame, and a second member operably associated with said body for urging the latch toward disengagement with the frame, said body, said first member, and said second member having a one-piece construction.

10. A drawer as in claim 9, wherein said body, said first member, and said second member are integrally molded from a plastic material.

11. A drawer slidably mounted to a frame for use in a printing machine, the drawer including a latch for releaseably securing the drawer to a frame of the printing machine, the latch comprising:

a housing mounted to the movable member;

a pin movably mounted to said housing for selectable engagement and disengagement with the frame;

an actuator movably mounted to said housing and cooperating with said pin, said actuator having a first relaxed position in which said pin is in engagement with the frame and a second restrained position in which said pin is in disengagement with the frame; and a separating member operably associated with said actuator for separating said actuator from the frame.

12. A drawer slidably mounted to a frame for use in a printing machine, the drawer including a latch for releaseably securing the drawer to a frame of the printing machine, the latch comprising:

a housing mounted to the movable member;

a pin movably mounted to said housing for selectable engagement and disengagement with the frame; and an actuator movably mounted to said housing and cooperating with said pin, said actuator having a first relaxed position in which said pin is in engagement with the frame and a second restrained position in which said pin is in disengagement with the frame, said actuator including a body, a first member operably associated with said body for urging the latch toward engagement with the frame, said first member having a portion thereof made of a resilient material, said resilient portion of said first member having a first relaxed position in which the latch is in engagement with the frame and a second restrained position in which the latch is in disengagement with the frame, a second member operably associated with said body for urging the latch toward disengagement with the frame, said second member being integral with said body and including a surface thereof in sliding contact with the latch, a separating member operably associated with said body for separating the actuator from the frame, said separating member being integral with said body and comprising a surface thereof in contact with the frame, and an urging member operably associated with said body for urging said actuator toward a latched position with respect to the movable member so that the latch may be in engagement with the frame, said urging member comprising a portion thereof made of a resilient material, said resilient portion of said urging member having a first relaxed position in which the latch may be in engagement with the frame and a second restrained position in which the latch may not be in engagement with the frame, said body, said separating member, said urging member, said first member, and said second member being integrally molded from a plastic material.

13. A printing machine including a drawer slidably mounted to a frame for use in a printing machine, the drawer including a latch for releaseably securing the drawer to a frame of the printing machine, the latch comprising:

a housing mounted to the movable member;

a pin movably mounted to said housing for selectable engagement and disengagement with the frame; and an actuator movably mounted to said housing and cooperating with said pin, said actuator having a first relaxed position in which said pin is in engagement with the frame and a second restrained position in which said pin is in disengagement with the frame, said actuator including a body, a first member operably associated with said body for urging the latch toward engagement with the frame, and a second member operably associated with said body for urging the latch toward disengagement with the frame, said body, said first member, and said second member having a one-piece construction.

14. A printing machine as in claim 13, wherein said body, said first member, and said second member are integrally molded from a plastic material.

15. A printing machine including a drawer slidably mounted to a frame for use in a printing machine, the drawer including a latch for releaseably securing the drawer to a frame of the printing machine, the latch comprising:

a housing mounted to the movable member;

a pin movably mounted to said housing for selectable engagement and disengagement with the frame;

an actuator movably mounted to said housing and cooperating with said pin, said actuator having a first relaxed position in which said pin is in engagement with the frame and a second restrained position in which said pin is in disengagement with the frame; and a separating member operably associated with said actuator for separating said actuator from the frame.

16. A printing machine including a drawer slidably mounted to a frame for use in a printing machine, the drawer including a latch for releaseably securing the drawer to a frame of the printing machine, the latch comprising:

a housing mounted to the movable member;

a pin movably mounted to said housing for selectable engagement and disengagement with the frame; and an actuator movably mounted to said housing and cooperating with said pin, said actuator having a first relaxed position in which said pin is in engagement with the frame and a second restrained position in which said pin is in disengagement with the frame, said actuator including a body, a first member operably associated with said body for urging the latch toward engagement with the frame, said first member having a portion thereof made of a resilient material, said resilient portion of said first member having a first relaxed position in which the latch is in engagement with the frame and a second restrained position in which the latch is in disengagement with the frame, a second member operably associated with said body for urging the latch toward disengagement with the frame, said second member being integral with said body and including a surface thereof in sliding contact with the latch, a separating member operably associated with said body for separating the actuator from the frame, said separating member being integral with said body and comprising a surface thereof in contact with the frame, and an urging member operably associated with said body for urging said actuator toward a latched position with respect to the movable member so that the latch may be in engagement with the frame, said urging member comprising a portion thereof made of a resilient material, said resilient portion of said urging member having a first relaxed position in which the latch may be in engagement with the frame and a second restrained position in which the latch may not be in engagement with the frame, said body, said separating member, said urging member, said first member, and said second member being integrally molded from a plastic material.

* * * * *